US009316194B2

(12) United States Patent
Grandi et al.

(10) Patent No.: US 9,316,194 B2
(45) Date of Patent: Apr. 19, 2016

(54) INJECTOR FOR INJECTING FLUID

(75) Inventors: Mauro Grandi, Livorno (IT); Valerio Polidori, Livorno (IT); Cristiano Mannucci, Livorno (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 124 days.

(21) Appl. No.: 14/122,207

(22) PCT Filed: May 23, 2012

(86) PCT No.: PCT/EP2012/059616

§ 371 (c)(1),
(2), (4) Date: Nov. 25, 2013

(87) PCT Pub. No.: WO2012/160100

PCT Pub. Date: Nov. 29, 2012

(65) Prior Publication Data

US 2014/0123946 A1 May 8, 2014

(30) Foreign Application Priority Data

May 23, 2011 (EP) ..... 11167084

(51) Int. Cl.
*F02M 69/04* (2006.01)
*F02M 51/06* (2006.01)

(52) U.S. Cl.
CPC ..... *F02M 69/04* (2013.01); *F02M 51/066* (2013.01); *F02M 51/0664* (2013.01); *F02M 2200/306* (2013.01)

(58) Field of Classification Search
CPC ..... F02M 51/0671; F02M 51/0685; F02M 61/18; F02M 61/12; F02M 51/0664; F02M 2200/06; F02M 51/066; F02M 51/061; F02M 51/0653; F02M 51/0657; F02M 51/0675; F02M 61/10
USPC ..... 123/445, 444, 457; 239/584, 239/585.3–585.5
See application file for complete search history.

(56) References Cited

U.S. PATENT DOCUMENTS 7,255,091 B2 8/2007 Barnes et al. ..... 123/506
2008/0277505 A1* 11/2008 Hoang ..... 239/585.5
(Continued)

FOREIGN PATENT DOCUMENTS

CN 101189425 A 5/2008 ..... F02D 41/20
CN 102003552 A 4/2011 ..... F16K 11/22
(Continued)

OTHER PUBLICATIONS

International Search Report and Written Opinion, Application No. PCT/EP2012/059616, 7 pages, Jun. 28, 2012.
(Continued)

*Primary Examiner* — Lindsay Low
*Assistant Examiner* — Long T Tran
(74) *Attorney, Agent, or Firm* — Slayden Grubert Beard PLLC

(57) ABSTRACT

An injector for injecting fluid includes a valve needle axially moveable with respect to a valve body and operable to prevent a fluid injection in a closing position and to permit the fluid injection in an open position, an armature for moving the valve needle in a first direction from the closing position towards the open position, a needle retainer fixed to the valve needle, and an armature holder fixed to the armature, wherein the needle retainer and the armature holder are releasably coupleable such that when the armature moves in the first direction the needle is moved in the first direction by the movement of the armature holder and the needle retainer.

10 Claims, 2 Drawing Sheets

(56) References Cited

U.S. PATENT DOCUMENTS

| | | | | |
|---|---|---|---|---|
| 2009/0289131 | A1* | 11/2009 | Shingu et al. | 239/585.5 |
| 2011/0049272 | A1 | 3/2011 | Harcombe et al. | 239/584 |
| 2012/0080011 | A1* | 4/2012 | Cooke | 123/472 |
| 2012/0325923 | A1* | 12/2012 | Hartfelder | A01G 25/16 239/1 |
| 2012/0325926 | A1* | 12/2012 | Moore et al. | 239/5 |

FOREIGN PATENT DOCUMENTS

| | | | | |
|---|---|---|---|---|
| DE | 102004056424 | A1 | 5/2006 | F02M 51/06 |
| EP | 1460263 | A1 | 9/2004 | F02M 51/06 |
| EP | 1550804 | A1 | 7/2005 | F02M 51/06 |
| WO | 2012/160100 | A1 | 11/2012 | F02M 51/06 |

OTHER PUBLICATIONS

European Search Report, Application No. 11169988.0, 5 pages, Oct. 31, 2011.

European Office Action, Application No. 11169988.0, 4 pages, Nov. 25, 2013.

Chinese Office Action, Application No. 201280024867.X, 11 pages, May 22, 2015.

* cited by examiner

INJECTOR FOR INJECTING FLUID

CROSS-REFERENCE TO RELATED APPLICATIONS

This application is a U.S. National Stage Application of International Application No. PCT/EP2012/059616 filed May 23, 2012, which designates the United States of America, and claims priority to EP Application No. 11167084.0 filed May 23, 2011, the contents of which are hereby incorporated by reference in their entirety.

TECHNICAL FIELD

The invention relates to an injector for injecting fluid and relates particularly to an injector for injecting fuel into an internal combustion engine.

BACKGROUND

Injection valves are in widespread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a valve needle of the injection valve, which may, for example, be an electromagnetic actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar.

After a desired injection during the injector closing phase a post injection can occur caused by an injector reopening. Current injector design includes very often a needle armature de-coupled feature. This design increases the impact between armature and upper armature retainer and also allows the needle to have the so called needle overshoot behavior. The needle overshoot happens during the injector standard operating mode: there is a needle overshoot during the needle opening phase. The needle overshoot during the opening phase occurs after that the armature impacts the pole piece impact face. When the armature stops and bounces against the pole piece impact face, the needle continues its motions by the effect of its inertia. By means of this phenomenon the opening phase is controlled for the armature but it is not controlled for the needle. Since the needle movement is responsible for fuel delivery, it happens that just at the end of the opening phase the needle is not in a controlled position in respect to the injector seat. This is unfavorable injector behavior and it impacts in particular way the minimum controllable deliverable flow. Due to the opening phase needle overshoot behavior, the minimum controllable flow quantity is increased. During the closing phase the armature overshoot occurs in the opposite direction, the armature detaches from the armature upper retainer and compresses the anti bounce spring eliminating the needle bounce at closing. Once that the anti bounce spring is compressed it releases the stored energy pushing again the armature against the upper armature retainer generating the unwanted and uncontrolled operating condition of the so called post injection.

SUMMARY

One embodiment provides an injector for injecting fluid, comprising a valve needle, being axially moveable with respect to a valve body and being operable to prevent a fluid injection in a closing position and to permit the fluid injection in an open position, an armature for moving the valve needle in a first direction from the closing position towards the open position, a needle retainer that is fixed to the valve needle, an armature holder that is fixed to the armature, the needle retainer and the armature holder are releasably coupleable such that when the armature moves in the first direction the needle is moved in the first direction by the movement of the armature holder and the needle retainer.

In a further embodiment, the armature holder is realized with a cross section in an L-form.

In a further embodiment, the injector comprises a welded connection between the armature holder and the armature to fix the armature holder to the armature.

In a further embodiment, the needle retainer is realized with a cross section in an L-form.

In a further embodiment, the injector comprises a welded connection between the needle retainer and the valve needle to fix the needle retainer to the valve needle.

In a further embodiment, the armature holder and the needle retainer are formed such that the armature holder and the needle retainer comprise a common contact area.

In a further embodiment, the injector comprises a spring between the needle retainer and the armature.

In a further embodiment, the injector comprises a needle guide that is fixed to the needle such that a free space is arranged between the needle guide and the armature during a movement of the armature in the first direction.

BRIEF DESCRIPTION OF THE DRAWINGS

Example embodiments of the invention are discussed below with reference to the drawings, in which.

DETAILED DESCRIPTION

Figure 1:
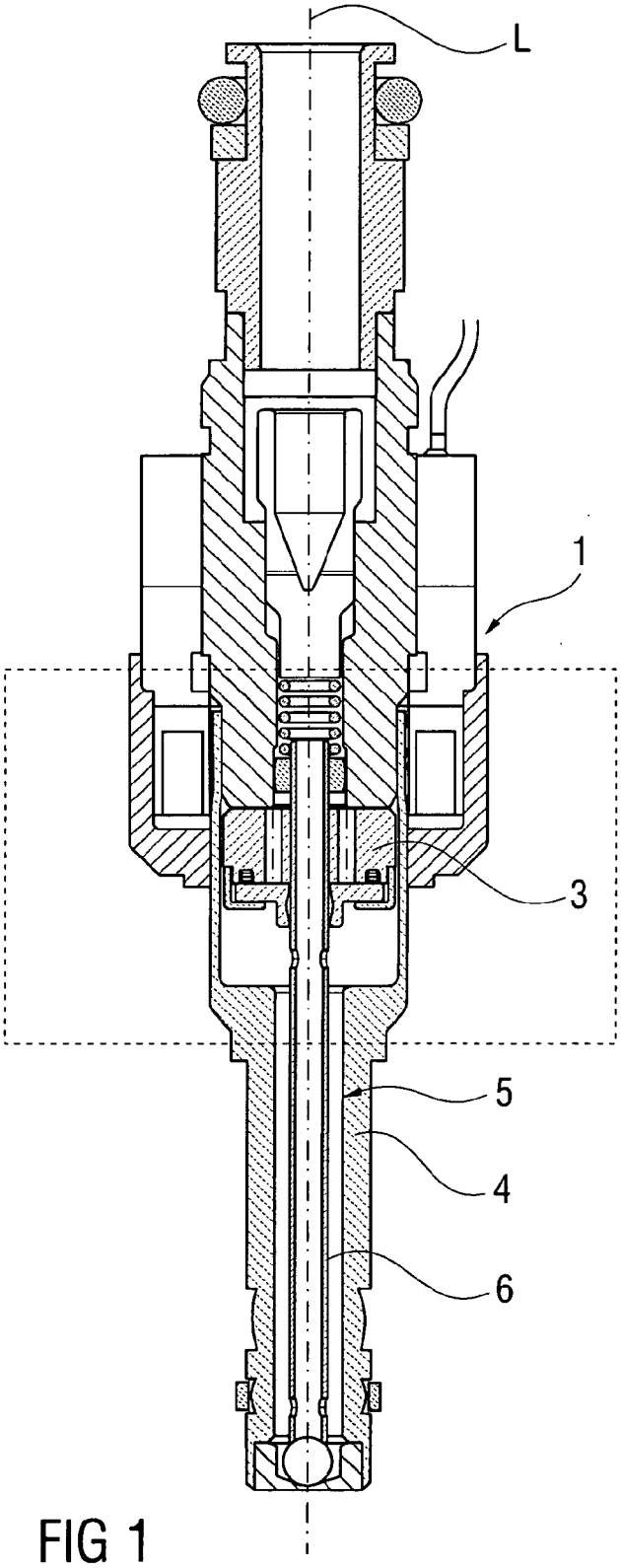
FIG. 1 schematically shows an injector according to an embodiment.

Embodiments of the invention provide an injector for injecting fluid that works reliably.

Some embodiments provide an injector for injecting fluid. The injector comprises a valve needle being axially movable relative to a valve body. The valve needle is operable to prevent the fluid injection in a closing position and to permit the fluid injection in an open position. The injector further comprises an armature for moving the valve needle in a first direction from the closing position towards the open position. The injector further comprises a needle retainer that is fixed to the valve needle, and an armature holder that is fixed to the armature. The needle retainer and the armature holder are releasably coupleable such that when the armature moves in the first direction, the needle is moved in the first direction by the movement of the armature holder and the needle retainer.

The armature holder and the needle retainer are arranged such that the armature holder is able to apply a compressive force to the needle retainer. The armature holder is arranged to affect a pressure on the needle retainer. The armature holder and the needle retainer are arranged such that the armature holder cannot apply a tractive force or a tension force to the needle retainer. The armature holder and the needle retainer are arranged such that the needle retainer needs to follow a movement of the armature holder in the first direction. The armature holder and the needle retainer are arranged such that the needle retainer is not forced to follow a movement in a second direction in the direction opposite the first direction of the armature holder. The armature holder pulls the needle retainer during the movement in the first direction. Due to the arrangement of the armature holder and the needle retainer with respect to each other, the overshoot of the armature and the needle during the opening and the closing phase is reduced. A maximum achievable overshoot is controllable.

According to further embodiment, the armature holder and the needle retainer each are realized with a cross-section in an L-form. The form of the armature holder and the form of the needle retainer correspond to each other. The armature holder and the needle retainer are formed such that the armature holder and the needle retainer comprise a common contact area. Therefore, the contact surfaces of the moving parts are larger and therefore, the contact pressure is reduced. The armature holder and the needle retainer therefore need no protective coating in the contact area.

The armature holder is fixed to the armature such that the armature holder moves when the armature moves. According to further aspects, the armature holder is welded to the armature such that the injector comprises a welded connection between the armature holder and the armature to fix the armature holder to the armature. The injector further comprises a welded connection between the needle retainer and the valve needle to fix the needle retainer to the valve needle. The needle retainer is welded to the valve needle such that the valve needle needs to follow a movement of the needle retainer.

According to a further embodiment, the injector comprises a spring that is arranged between the needle retainer and the armature.

FIG. 1 schematically shows an injector for injecting fluid. Particularly, the injector may be arranged in a multi-cylinder internal combustion engine of, for example, an automobile or other vehicle and designed for injecting fuel into a cylinder of the internal combustion engine of the vehicle. The fluid injector has a longitudinal axis L and further comprises a housing 1 and valve body 4. The valve body 4 is coupled with the housing 1 and has a recess 5 in which a valve needle 6 is arranged axially movable.

The valve needle 6 is of the hollow needle type and comprises a closing element at its downstream end arranged for closing the injector in its closed position inhibiting a fluid flow and for allowing the fluid flow otherwise in an open position. In the closing position of the fluid injector in which the fluid flow is inhibited, the valve needle 6, in particular the closing element, sealingly rests on a seat and prevents in this way the fluid flow through at least one injector nozzle. The injector nozzle may, for example, be an injector hole; it may, however, also be of some other type suitable for dosing fluid. The seat may be made as one part with the valve body 4 or may also be made as a separate part. A fluid injection is permitted if the valve needle 6 is in further positions.

The injector further comprises a lifting device with an actuator 8 (FIG. 2) for moving the valve needle 6 in its axial direction along the axis L for opening and/or closing the injector. The actuator may be a solenoid actuator. The actuator may alternatively be a piezo-actuator.

The housing 1 and an armature 3 form a magnetic circuit. The magnetic circuit guides a magnetic flux of a magnetic field being generated by the solenoid actuator 8.

The solenoid actuator 8 comprises at least one coil. The coil may be overmolded. The solenoid actuator may comprise more than one coil.

The actuator 8 is arranged to interact with the armature 3. The armature 3 cooperates with the valve needle 6 such that at least part of the lift generated by the actuator 8 with respect to the armature 3 is transferred to the valve needle 6, moving the valve needle and the closing element in its open position in which fluid injection is permitted. The armature 3 and the valve needle 6 can move relatively to each other. A needle closing force is provided by a calibration spring 17 (FIG. 2) that applies a force to the valve needle 6 in the closing direction.

Figure 2:
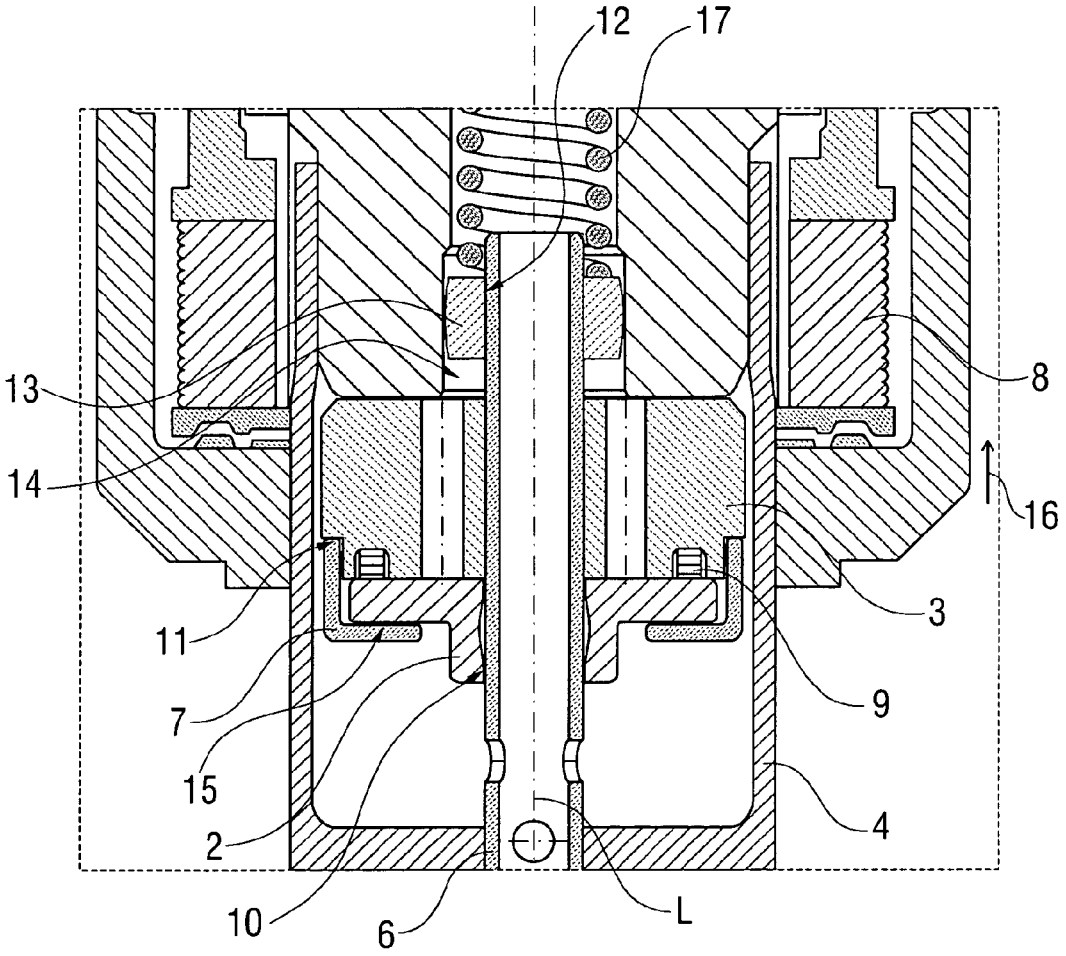
FIG. 2 schematically shows a section of the injector according to FIG. 1.

FIG. 2 shows a portion of the injector according to the embodiment of FIG. 1 in more detail.

The injector comprises a needle retainer 2 that is fixed to the valve needle 6. The needle retainer 2 is directly coupled with the valve needle 6. The needle retainer 2 is directly connected to the valve needle 6. The needle retainer 2 comprises a cross-section with the form of an L. The needle retainer 2 comprises a portion which is elongated in the direction of the L-axis and is at least partly in contact with the valve needle 6. The portion of the needle retainer 2 is fixed to the valve needle 6 such that the valve needle 6 and the needle retainer 2 cannot move relative to each other. In particular, the needle retainer 2 is welded with the portion to the valve needle 6 by a welded connection 10.

The needle retainer 2 comprises a second portion that is elongated transverse to the L-axis. The two portions form the L-shaped cross-section of the needle retainer 2.

The injector further comprises an armature holder 7 that is fixed to the armature 3. The armature holder 7 is directly coupled with the armature 3. The armature holder 7 is connected to the armature 3. The armature holder 7 comprises a cross-section in form of an L. The armature holder 7 comprises a portion that is elongated in the direction of the L-axis. The portion of the armature holder 7 is fixed to the armature 3. In particular, the armature holder 7 is fixed to the armature 3 by a welded connection 11. The armature holder 7 and the armature 3 are fixed to each other such that they cannot move relatively to each other.

The armature holder 7 comprises a further portion that is elongated transverse to the L-axis. The two portions of the armature holder 7 form the L-shaped cross-section of the armature holder 7.

The armature holder 7 and the needle retainer 2 are arranged inside the valve body 4 such that the respective portions that are directed transverse to the L-axis comprise a common contact area 15 at least during the opening phase of the injector. During the opening phase of the injector, the valve needle 6 moves in a direction 16 along the L-axis and thus, the closing element moves away from the seat.

The movement of the valve needle 6 in the direction 16 is forced by the movement of the armature 3 in the direction 16. The armature holder 7 moves along with the armature 3 in the direction 16 due to the fixed coupling of the armature holder 7 with the armature 3. A force directed in direction 16 is transmitted from the armature holder 7 to the needle retainer 2 via the contact area 15. At least during the movement of the armature in the direction 16, the needle retainer 2 is pushed by the armature holder 7 in the direction 16. Due to the fixed coupling of the needle retainer 2 with the valve needle 6, the valve needle 6 is moved in the direction 16 by the movement of the needle retainer 2. Such, a movement of the armature 3 causes a movement of the valve needle 6 via the armature holder 7 and the needle retainer 2.

The coupling of the armature 3, in particular the armature holder 7, with the needle retainer 2 is on the side of the armature 3 that is directed towards the closing element of the valve needle 6.

When the movement of the armature 3 in the direction 16 stops in the maximum open position at the maximum shift of the armature 3 in the direction 16, the valve needle 6 has very limited possibilities to move further in the direction 16 because the needle retainer 2 abuts the armature 3. Thus, the movement of the valve needle 6 in the direction 16 is stopped. This movement is further damped by springs 9 that are arranged between the needle retainer 2 and the armature 3. According to aspects, the spring 9 is a wave spring. According to further embodiments, the spring 9 is an elastic rubber. The spring 9 damps an uncontrolled movement or bouncing of the valve needle 6 when the armature 3 stops.

During the closing phase, the valve needle 6 is moved in a direction opposite the direction 16 along the L-axis. Therefore, the spring 17 applies a force on a needle guide 13 that is fixed to the valve needle 6. The needle guide 13 is fixed to the valve needle 6 by a welded connection 12. The needle guide 13 is arranged at the valve needle 6 on a side of the armature that is opposite the side on which the needle retainer 2 and the armature holder 7 are arranged.

The closing force is transmitted to the valve needle via the needle guide 13. Between the needle guide 13 and the armature 3 is a free space 14. Therefore, the armature 3 and the needle guide 13 have no common contact area. In particular, the armature 3 and the needle guide 13 have no contact during the whole closing phase and opening phase of the injector.

During the closing phase, the needle retainer 2 and the armature holder 7 can decouple. The armature holder 7 gets out of contact with the needle retainer 2 at least during a part of the closing phase. During the closing phase, the overshoot is also limited because the movement of the valve needle 6 is restricted by the movement of the needle retainer 2 that can only move between the armature 3 and the armature holder 7 along the L-axis.

This allows setting up the maximum possible overshoot of the armature 3 and the valve needle 6 and better controlling the injector behavior under both opening and closing operating conditions. Moreover the proposed design allows the larger contact area 15 between the armature holder 7 and the needle retainer 2 and thus, the wearing between the two components is reduced and the lift value maintained, in particular for the entire injector lifetime, within an acceptable range of variation. Further, there is no need of protective coating in the contact area 15 due to the large available area 15 and due to the reduced the specific contact pressure at the contact area 15. Furthermore, the overshoot during the opening phase and the closing phase is limited and thus allows a better injector dynamic control. The armature 3 is decoupled from the valve needle 6 in a way that the needle retainer 2 and the armature holder 7 together allow the relative movement of the armature 3 with respect to the valve needle 6 and the same elements (the needle retainer 2 and the armature holder 7) are responsible for limiting the armature 3 overshot and valve needle 6 overshoot.

What is claimed is:

1. An injector for injecting fluid, comprising:

a valve body having a longitudinal axis, a valve needle axially moveable along the longitudinal axis of the valve body to prevent a fluid injection in a closing position and to permit a fluid injection in an open position, an armature configured to move the valve needle in a first direction from the closing position towards the open position, a valve needle spring biased to move the valve needle in a second direction from the open position towards the closing position, a L-shaped needle retainer having first and second portions, a first needle retainer portion elongated in the direction of the longitudinal axis fixed to the valve needle and a second needle retainer portion elongated in a direction perpendicular to the longitudinal axis, the second needle retainer portion having top and bottom sides defining top and bottom contact areas on either side for contact with the armature on the top side and contact with an armature holder on the bottom side, and a L-shaped armature holder having first and second portions, a first armature holder portion elongated in the direction of the longitudinal axis fixed to the armature and a second armature holder portion elongated in a direction perpendicular to the longitudinal axis, the second armature holder portion having top and bottom sides defining a contact area on the top side for contacting the bottom side of the second needle retainer portion, wherein the needle retainer and the armature holder are releasably coupleable upon the armature moving towards the first direction, such that the needle is also moved towards the first direction by the movement of the armature holder in contact with the needle retainer, and the needle retainer and the armature holder are de-coupleable upon the valve needle moving towards the second direction, with the movement of the needle in the second direction limited by contact of the bottom side of the second needle retainer portion with the top side of the second armature holder portion.

2. The injector according to claim 1, comprising a welded connection between the armature holder and the armature that fixes the armature holder to the armature.

3. The injector according to claim 1, comprising a welded connection between the needle retainer and the valve needle that fixes the needle retainer to the valve needle.

4. The injector according to claim 1, further comprising a further spring between the needle retainer and the armature.

5. The injector according to claim 1, wherein the needle guide is fixed to the needle such that a free space is arranged between the needle guide and the armature during a movement of the armature in the first direction.

6. An internal combustion engine of a vehicle, comprising:

at least one cylinder;

an injector arranged for injecting fluid into each cylinder, each injector comprising:

a valve body having a longitudinal axis, a valve needle axially moveable along the longitudinal axis of the valve body to prevent a fluid injection in a closing position and to permit a fluid injection in an open position, an armature configured to move the valve needle in a first direction from the closing position towards the open position, a valve needle spring biased to move a valve needle in a second direction from the open position towards the closing position, a L-shaped needle retainer having first and second portions, a first needle retainer portion elongated in the direction of the longitudinal axis fixed to the valve needle and a second needle retainer portion elongated in a direction perpendicular to the longitudinal axis, the second needle retainer portion having top and bottom sides defining top and bottom contact areas on either side for contact with the armature on the top side and contact with an armature holder on the bottom side, and a L-shaped armature holder having first and second portions, a first armature holder portion elongated in the direction of the longitudinal axis fixed to the armature and a second armature holder portion elongated in a direction perpendicular to the longitudinal axis, the second armature holder portion having top and bottom sides defining a contact area on the top side for contacting the bottom side of the second needle retainer portion, wherein the needle retainer and the armature holder are releasably coupleable upon the armature moving towards the first direction, such that the needle is also moved towards the first direction by the movement of the armature holder in contact with the needle retainer, and the needle retainer and the armature holder are de-coupleable upon the valve needle moving towards the second direction, with the movement of the needle in the second direction limited by contact of the bottom side of the second needle retainer portion with the top side of the second armature holder portion.

7. The engine according to claim 6, comprising a welded connection between the armature holder and the armature that fixes the armature holder to the armature.

8. The engine according to claim 6, comprising a welded connection between the needle retainer and the valve needle that fixes the needle retainer to the valve needle.

9. The engine according to claim 6, further comprising a further spring between the needle retainer and the armature.

10. The engine according to claim 6, wherein the needle guide that is fixed to the needle such that a free space is arranged between the needle guide and the armature during a movement of the armature in the first direction.

* * * * *